US011077680B2

(12) United States Patent
Kanno et al.

(10) Patent No.: US 11,077,680 B2
(45) Date of Patent: Aug. 3, 2021

(54) PRINTING APPARATUS

(71) Applicant: SEIKO EPSON CORPORATION, Tokyo (JP)

(72) Inventors: Yusuke Kanno, Shiojiri (JP); Hiroyuki Endo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/895,008

(22) Filed: Jun. 8, 2020

(65) Prior Publication Data

US 2020/0384782 A1 Dec. 10, 2020

(30) Foreign Application Priority Data

Jun. 10, 2019 (JP) ..... JP2019-107829

(51) Int. Cl.
*B41J 11/02* (2006.01)
*B41J 11/00* (2006.01)
*B41J 11/04* (2006.01)

(52) U.S. Cl.
CPC ..... *B41J 11/0085* (2013.01); *B41J 11/0025* (2013.01); *B41J 11/04* (2013.01)

(58) Field of Classification Search
CPC ..... B41J 11/0085; B41J 11/04; B41J 11/0025; B41J 11/06; B41J 3/4075; B41J 11/02; B41J 2/01
See application file for complete search history.

(56) References Cited

U.S. PATENT DOCUMENTS 6,092,894 A * 7/2000 Nuita ..... B41J 13/226 271/196
6,406,017 B1 * 6/2002 Yaneda ..... B65H 5/224 271/196
10,661,584 B2 * 5/2020 Hirashima ..... B41J 15/046
2007/0132824 A1 * 6/2007 Iida ..... B41J 11/485 347/101
2012/0113179 A1 * 5/2012 Higuchi ..... B41J 11/0005 347/16
2012/0236101 A1 * 9/2012 Kato ..... B41J 11/06 347/104

(Continued)

FOREIGN PATENT DOCUMENTS

JP 2010-18367 * 1/2010 ..... B41J 11/02
JP 2012-101500 A 5/2012

OTHER PUBLICATIONS

Machine translation of JP 2012-101500, published on May 2012.*

*Primary Examiner* — Huan H Tran
(74) *Attorney, Agent, or Firm* — Workman Nydegger

(57) ABSTRACT

A printing apparatus includes a transport roller configured to transport a print medium in a transport direction, a print head configured to print on the print medium, a platen having first suction arrays each including at least a first suction hole having a first diameter and second suction arrays each including at least a second suction hole having a second diameter that is different from the first diameter, the first suction arrays and the second suction arrays being alternately arranged in a direction intersecting the transport direction, a suction fan configured to suck the print medium through frame portions each having one first suction array and one second suction array, and a shutter mechanism configured to open or close the frame portions stepwise.

5 Claims, 10 Drawing Sheets

(56) References Cited

U.S. PATENT DOCUMENTS

| | | | | |
|---|---|---|---|---|
| 2012/0256925 | A1* | 10/2012 | Stannard | G06T 11/206<br>345/440 |
| 2018/0207959 | A1* | 7/2018 | Hirashima | B41J 2/04 |
| 2018/0207964 | A1* | 7/2018 | Hirashima | B41J 11/02 |

* cited by examiner

PRINTING APPARATUS

The present application is based on, and claims priority from JP Application Serial Number 2019-107829, filed Jun. 10, 2019, the disclosure of which is hereby incorporated by reference herein in its entirety.

BACKGROUND

1. Technical Field

The present disclosure relates to a printing apparatus.

2. Related Art

JP-A-2012-101500 discloses a printing apparatus that includes a shutter for blocking suction holes of a platen depending on the width of a print medium.

The size of each suction hole of the known printing apparatus is large, and this may provide a relatively large suction hole blocking mechanism and a relatively large printing apparatus.

SUMMARY

According to an aspect of the present disclosure to solve the above-described problem, a printing apparatus includes a transport roller configured to transport a print medium in a transport direction, a print head configured to print on the print medium, a platen having first suction arrays each including at least a first suction hole having a first diameter and second suction arrays each including at least a second suction hole having a second diameter that is different from the first diameter, the first suction arrays and the second suction arrays being alternately arranged in a direction intersecting the transport direction, a suction fan configured to suck the print medium through frame portions each having one first suction array and one second suction array, and a shutter mechanism configured to open or close the frame portions stepwise.

In the printing apparatus, the first diameter may be larger than the second diameter.

In the printing apparatus, the platen may have a reference position along which an end of the print medium in a width direction passes through, and each of the frame portions may include the second suction array and the first suction array that is closer to the reference position than the second suction array.

In the printing apparatus, the shutter mechanism may include a drum having first openings corresponding to the frame portions and second openings of sizes different from the sizes of the first openings, the first openings and the second openings being arranged in the direction intersecting the transport direction, and a drum drive unit configured to drive the drum to rotate.

In the printing apparatus, the shutter mechanism may include an air intake chamber that communicates with the frame portions and the suction fan, and the drum may be rotated in the air intake chamber to open or close stepwise the frame portions.

DESCRIPTION OF EXEMPLARY EMBODIMENTS

Hereinafter, embodiments of the present disclosure will be described with reference to the attached drawings. The embodiments described below do not limit the scope of the disclosure described in the claims. Furthermore, not all structures described in the embodiments are always necessary for the present disclosure.

1. Overall Structure of Printing Apparatus

Figure 1:
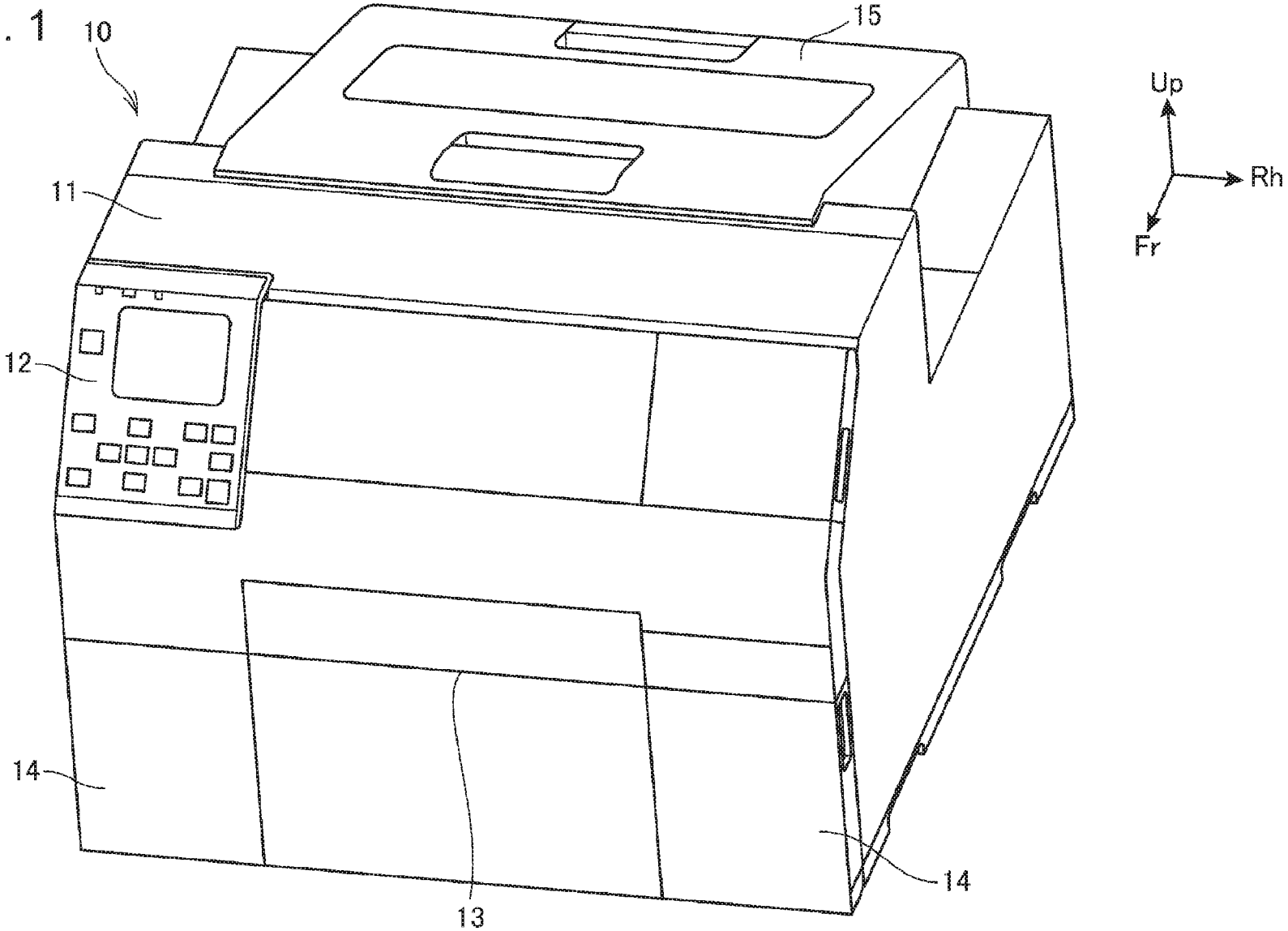
FIG. 1 is an external view illustrating a printing apparatus.
Figure 2:
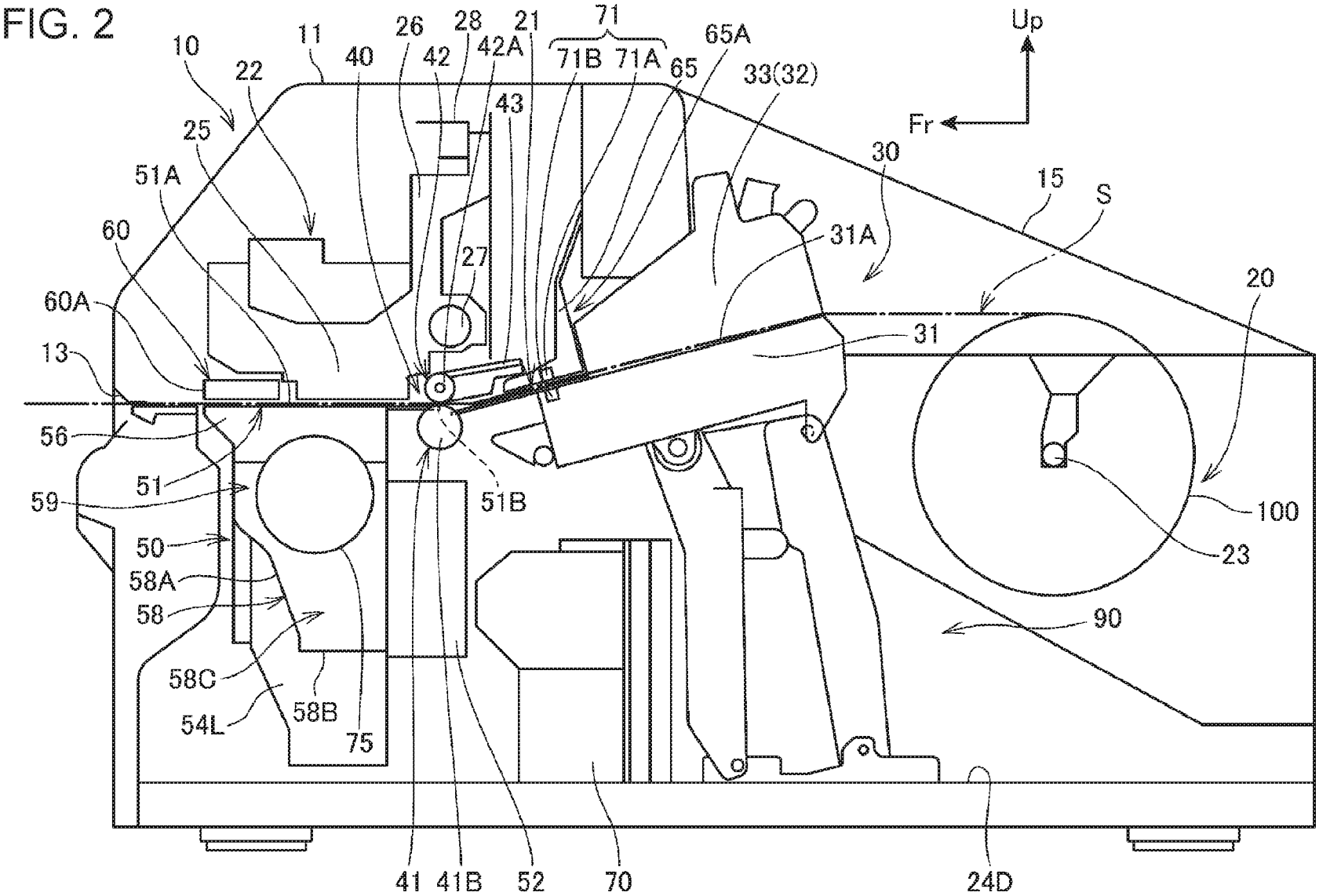
FIG. 2 is a vertical cross-sectional view of a printing apparatus taken along a center in a left-right direction.

FIG. 1 is an external view illustrating a printing apparatus 10. FIG. 2 is a vertical cross-sectional view of the printing apparatus 10 taken along a center in a left-right direction. In the drawings, with respect to the installation states of the printing apparatus 10, an upward side of the printing apparatus 10 is referred to as Up, a front side of the printing apparatus 10 is referred to as Fr, and a right side of the printing apparatus 10 is referred to as Rh.

The printing apparatus 10 is a printer for printing on a continuous sheet S such as a label sheet, which consists of a long liner and labels attached on the liner at certain intervals, and such a printer is also referred to as a label printer. The continuous sheet S is an example print medium. The printing apparatus 10 is coupled to an information processing terminal via a wired or wireless connection such as a universal serial bus (USB) cable or a local area network (LAN), and performs printing based on print data sent from the information processing terminal.

As illustrated in FIG. 1, the printing apparatus 10 includes a case 11 that is a housing of the printing apparatus 10. On a front left portion of the case 11, an operation panel 12 that has operation buttons and the like is provided. In a front center portion of the case 11, a slit-shaped sheet discharge port 13 through which a printed continuous sheet S is discharged is provided. On left and right sides of the sheet discharge port 13, an attachment section cover 14 that covers an ink cartridge attachment section is provided. The attachment section cover 14 is opened or closed to replace an ink cartridge.

On a rear upper surface of the case 11, a cover 15 is disposed. The cover 15 is moved to an open position and opened to expose a guide unit 30 that is disposed in a transport path 21 for a continuous sheet S. The cover 15 according to the embodiment can be rotated about a hinge (not illustrated) between an open position and a closed position. The transport path 21 is an example transport path.

As illustrated in FIG. 2, the printing apparatus 10 includes a housing 20, the transport path 21, and a print section 22. The housing 20 houses roll paper 100, which is a rolled continuous sheet S. The transport path 21 extends from the housing 20 to the sheet discharge port 13 of the case 11. The print section 22 is used to print on a continuous sheet S at a predetermined position in the transport path 21. The continuous sheet S is not limited to the label sheet, and various types of paper may be used. For example, a paper sheet that is folded about perforations formed at certain intervals in a longitudinal direction, so-called fanfold paper may be used. In this embodiment, the roll paper 100 is used as the continuous sheet S. A direction in which the continuous sheet S is transported from the housing 20 along the transport path 21 toward the sheet discharge port 13 is referred to as a transport direction, and a direction orthogonal to the transport direction is referred to as a width direction. The left-right direction is an example width direction.

The housing 20 is provided below the cover 15 in the case 11. The roll paper 100 is rotatably supported by a roll paper rotation shaft 23 at a side wall section of the housing 20.

In an upper front portion of the housing 20, the guide unit 30 is disposed. The guide unit 30 is an example guide member. The guide unit 30 functions as a paper guide for the continuous sheet S. The guide unit 30 includes a guide base 31 that can support a lower side of the continuous sheet S that is fed from the housing 20. The guide base 31 includes an upper side plate 31A that extends in the width direction and is inclined downward toward the front side. The guide base 31 supports a side-wall-shaped fixed guide 32 for guiding the continuous sheet S and a movable guide 33. The fixed guide 32 is fixed to a left side of the upper side plate 31A. The left side is an example one side in the width direction. The movable guide 33 is supported so as to be able to be slid in the width direction of the upper side plate 31A, and is supported to be able to be moved toward or away from the fixed guide 32. The guide unit 30 is supported by a support mechanism 90.

The fixed guide 32 and the movable guide 33 extend in the transport direction of the continuous sheet S. The fixed guide 32 and the movable guide 33 come into contact with end portions of the continuous sheet S in the width direction, that is, side ends that are end portions in the left-right direction to guide the side ends of the continuous sheet S. The continuous sheet S is transported along the side of the fixed guide 32 as a positional reference.

In the printing apparatus 10, in adjusting the positions of the guides 32 and 33 depending on the sheet width of the continuous sheet S, a user adjusts the position of the movable guide 33 in a state in which the side end of the continuous sheet S is in contact with the fixed guide 32. With this structure, the side end of the continuous sheet S that is in contact with the fixed guide 32 is always aligned at the same position in the width direction irrespective of the sheet width of the continuous sheet S.

Figure 3:
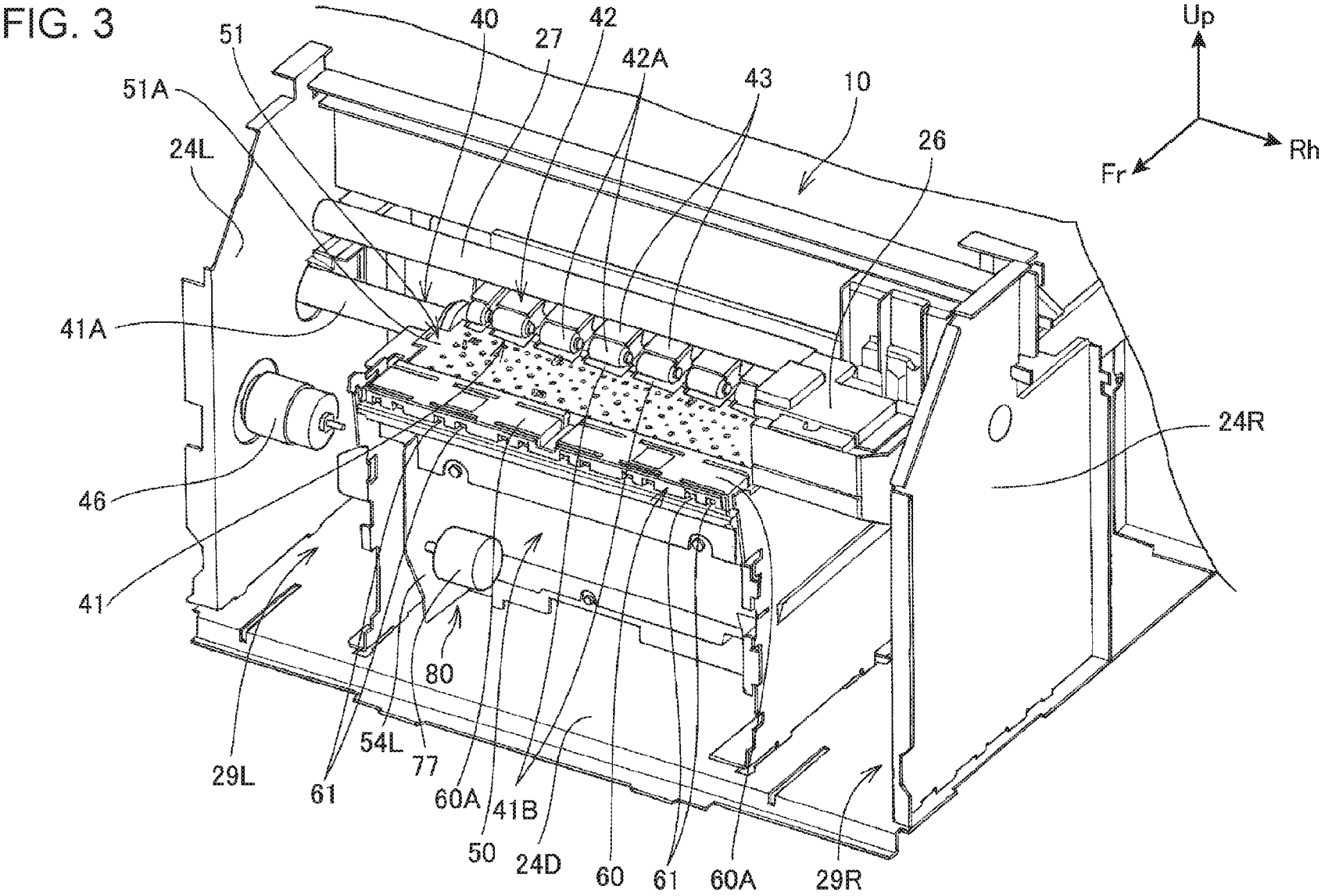
FIG. 3 is a perspective view illustrating an internal structure of a printing apparatus.

FIG. 3 is a perspective view illustrating an internal structure of the printing apparatus 10. The printing apparatus 10 includes a plate-like bottom frame 24D and side-wall-shaped side frames 24L and 24R that are vertically disposed on both sides of the bottom frame 24D in the left-right direction. The frames 24D, 24L, and 24R are covered with the case 11. The side frames 24L and 24R support a paper feed roller 40. The paper feed roller 40 is disposed on a downstream of the guide unit 30 in the transport direction. The paper feed roller 40 includes a driving roller 41 and a driven roller 42 that faces the driving roller 41. The paper feed roller 40 may be referred to as a transport roller.

The driving roller 41 includes a shaft section 41A that extends in the width direction and roller sections 41B. Each of the roller sections 41B is provided in the shaft section 41A and has a diameter larger than that of the shaft section 41A. The driving roller 41 is rotatably supported by the side frames 24L and 24R. The roller sections 41B are provided in the shaft section 41A at certain intervals in the shaft direction.

Above the driving roller 41, the driven roller 42 is disposed. The driven roller 42 has roller bodies 42A. Each roller body 42A is provided for each roller section 41B of the driving roller 41 and is disposed to face the roller section 41B. Each roller body 42A is supported by an arm 43 that extends in the front/rear direction. Each roller body 42A is disposed at a front end portion of the arm 43 so as to be rotated about a rotation center that extends in the width direction. The arms 43 are rotatably supported by the side frames 24L and 24R at a rear end so as to be rotated about a rotation center that extends in the width direction. Each arm 43 is urged by an urging member (not illustrated) such that the roller body 42A is pressed against the driving roller 41. The driving roller 41 and the driven roller 42 pinch and transport the continuous sheet S.

The left side frame 24L supports a transport motor 46. The transport motor 46 transmits the power to the driving roller 41 via a power transmission member (not illustrated). The transport motor 46 can be driven in a forward direction or in a reverse direction to rotate the driving roller 41 in the forward direction or in the reverse direction. The activated transport motor 46 drives the driving roller 41. The driven roller 42 that is pressed against the driving roller 41 rotates as the driving roller 41 rotates.

As illustrated in FIG. 2, on the downstream of the paper feed roller 40 in the transport direction, the print section 22 is disposed. The print section 22 includes an ink jet head 25 that discharges an ink onto a continuous sheet S. The ink jet head 25 is an example print head. The ink jet head 25 is mounted in the carriage 26. The carriage 26 is supported along a carriage shaft 27 that extends in the width direction such that the carriage 26 can be moved in the width direction. Furthermore, the carriage 26 is supported so as to be moved along a guide frame 28 that is disposed in the case 11. The carriage 26 is moved along the carriage shaft 27 and the guide frame 28 and thereby the ink jet head 25 is moved in a main scanning direction.

The ink jet head 25 has nozzle arrays, for example, that correspond to inks of four colors of cyan, magenta, yellow, and black (CMYK). The ink jet head 25 is supplied with the inks from ink cartridges (not illustrated) and discharges the inks from nozzles in the nozzle arrays to form dots onto a continuous sheet S to print an image. The ink jet head 25 may be referred to as a print head.

As illustrated in FIG. 3, in left and right lower portions of the printing apparatus 10, ink cartridge mounting sections 29L and 29R are provided. To ink cartridges that are mounted in the ink cartridge mounting sections 29L and 29R, through tubes (not illustrated), a pressure pump unit 70 illustrated in FIG. 2 is coupled. The pressure pump unit 70 is driven and applies pressure to the ink cartridges, and thereby the inks are supplied through ink flow paths (not illustrated) to the ink jet head 25.

The number of colors of the inks to be used in the printing apparatus 10 is not limited to four, and for example, a special color ink may be provided in addition to the four colors of CMYK, and printing may be performed with the multicolor inks. The printing apparatus 10 may be configured to perform monochrome printing or two-color printing.

In the transport path 21, at a position facing the ink jet head 25, a platen unit 50 is disposed. The platen unit 50 includes a suction platen 51 on an upper surface. The suction platen 51 has a planar mounting surface 51A and extends over an area in which the ink jet head 25 can form dots. A continuous sheet S that is mounted on the mounting surface 51A is sucked by a suction fan 52 that is disposed on a rear portion of the platen unit 50. The printing apparatus 10 transports the continuous sheet S while the suction platen 51 is operating, that is, the continuous sheet S is being sucked such that the continuous sheet S is prevented from freely moving from the suction platen 51. Accordingly, the distance between the continuous sheet S and the ink jet head 25 of the print section 22 can be appropriately maintained.

A star wheel unit 60 is disposed above the suction platen 51 to face a downstream portion of the suction platen 51 in the transport direction. As illustrated in FIG. 3, the star wheel unit 60 has star wheels 61 that are example transport members. Each star wheel 61 has protrusions on its outer periphery at a predetermined angular pitch. The star wheels 61 are rotatably supported by a frame 60A of the star wheel unit 60. The star wheels 61 are disposed at certain intervals in the width direction. The areas of the star wheels 61 that come into contact with a continuous sheet S are small, and thus the star wheels 61 can transport the continuous sheet S while reducing the deterioration in image quality of the image recorded on the continuous sheet S.

As illustrated in FIG. 2, on the downstream of the suction platen 51 in the transport direction, a cutter unit (not illustrated) for cutting a continuous sheet S may be mounted. The cutter unit may cut a portion of the continuous sheet S in the width direction without completely cutting the continuous sheet S or may completely cut the continuous sheet S. The printing apparatus 10 can cut the continuous sheet S that has been printed by the ink jet head 25 by using the cutter unit in a predetermined length, and discharge the cut continuous sheet S from the sheet discharge port 13.

In the case 11, the transport path 21 on which a continuous sheet S is transported from the housing 20 toward the sheet discharge port 13 extends along the guide unit 30, the paper feed roller 40, the suction platen 51, and the sheet discharge port 13.

A guide wall 65 is disposed on an upper side of the downstream of the guide unit 30 in the transport direction. The guide wall 65 extends in the width direction and is supported by the side frames 24L and 24R. The guide wall 65 extends from an upper side to a lower side and is bent toward the downstream in the transport direction and is bent more toward the downstream in a lower portion. A lower end portion of the guide wall 65 faces the upper side plate 31A of the guide unit 30 on the downstream in the transport direction. In this embodiment, a continuous sheet S that is different from the roll paper 100 can be transported from above the guide wall 65 along the guide wall 65 toward the guide unit 30. The continuous sheet S that is transported above the guide wall 65 along the guide wall 65 can be transported by the paper feed roller 40. An upper transport path 65A extends from above and along the guide wall 65.

Between the guide wall 65 and the guide unit 30, an optical sensor 71 is disposed. The optical sensor 71 is disposed on the transport path 21 that is on a downstream of the upper transport path 65A. The optical sensor 71 is a sensor for detecting labels on a continuous sheet S, a so-called label detector. The optical sensor 71 includes a light emitter 71A that emits detection light and a light receiver 71B that receives the detection light. The light emitter 71A is disposed on the guide wall 65 and the light receiver 71B is disposed on the guide unit 30 so as to face the light emitter 71A. The light receiver 71B may be disposed on the guide wall 65 and the light emitter 71A may be disposed on the guide unit 30. The optical sensor 71 outputs a detection value corresponding to the amount of the light received by the light receiver 71B. The printing apparatus 10 determines the presence of a label sheet at the position of the optical sensor 71 based on the detection value from the optical sensor 71.

2. Platen Unit Structure

Figure 4:
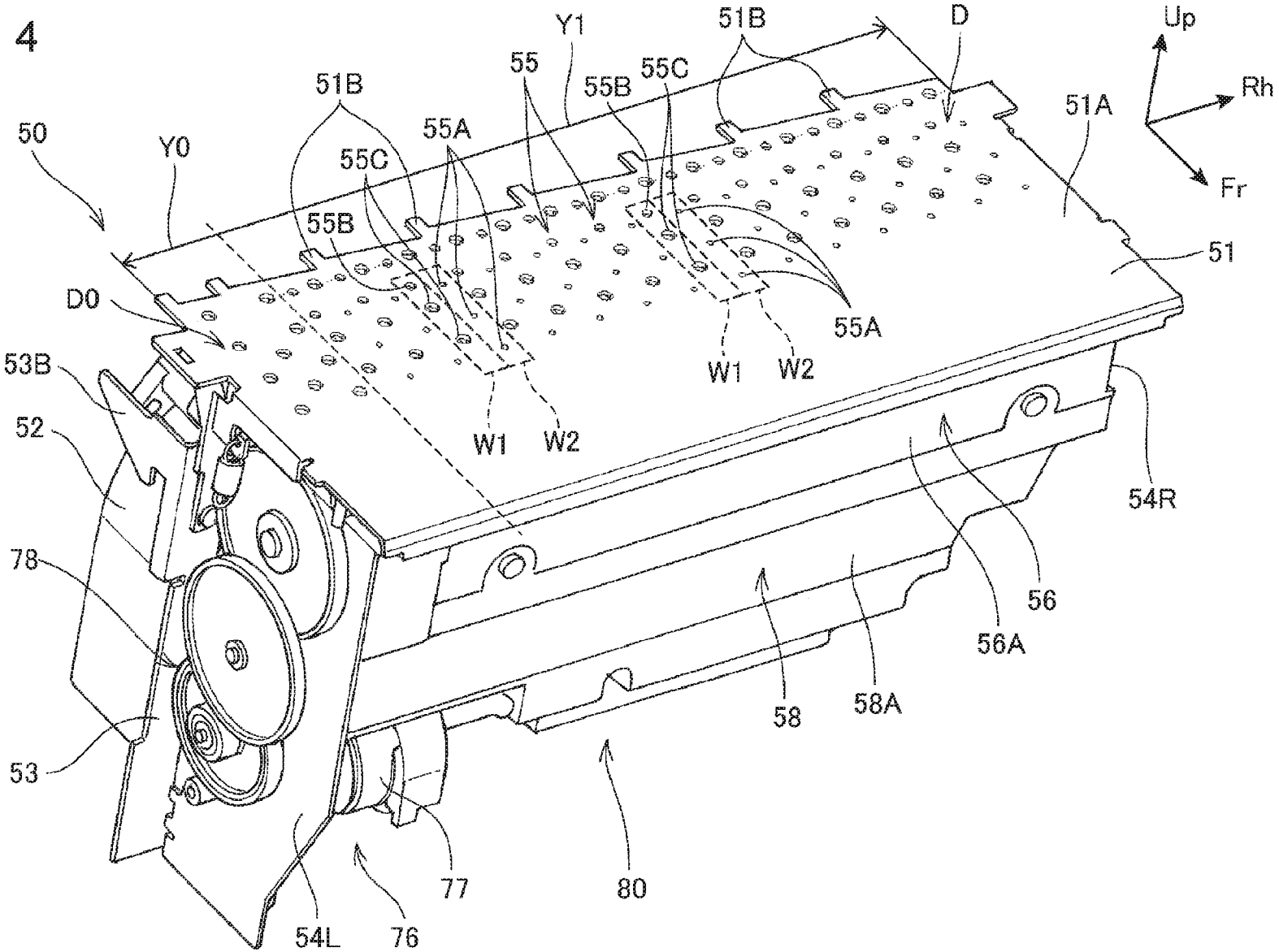
FIG. 4 is a perspective view of a platen unit.

FIG. 4 is a perspective view of the platen unit 50. In the following description, when simply referred to as "upstream" or "downstream", it means upstream or downstream with respect to the transport direction of the continuous sheet S. The platen unit 50 includes a wall-shaped fixed plate 53 on a rear side. At both ends of the fixed plate 53 in the width direction, wall-shaped side plates 54L and 54R that extend forward are supported. On the fixed plate 53 and the side plates 54L and 54R, the suction platen 51 is supported. The suction platen 51 is an example platen. At both ends of the fixed plate 53 in the width direction, engaging claws 53B that extend rearward are provided. The engaging claws 53B engage with a frame (not illustrated) in the printing apparatus 10, and thereby the platen unit 50 is disposed in the printing apparatus 10.

The plate-like suction platen 51 extends in the width direction. An upper surface of the suction platen 51 serves as the planar mounting surface 51A on which a continuous sheet S is transported. Upstream portions of the suction platen 51 in the transport direction have protrusion pieces 51B that protrude toward the upstream in the transport direction. The protrusion pieces 51B are formed at certain intervals in the width direction. The protrusion pieces 51B are disposed in the spaces between the roller sections 41B of the driving roller 41, and as illustrated in FIG. 2, the protrusion pieces 51B overlap with the roller sections 41B in side view. With this structure, a continuous sheet S can be prevented from entering the gap between the paper feed roller 40 and the suction platen 51, and the continuous sheet S fed from the paper feed roller 40 can be mounted on the suction platen 51 without being caught on the suction platen 51.

Figure 5:
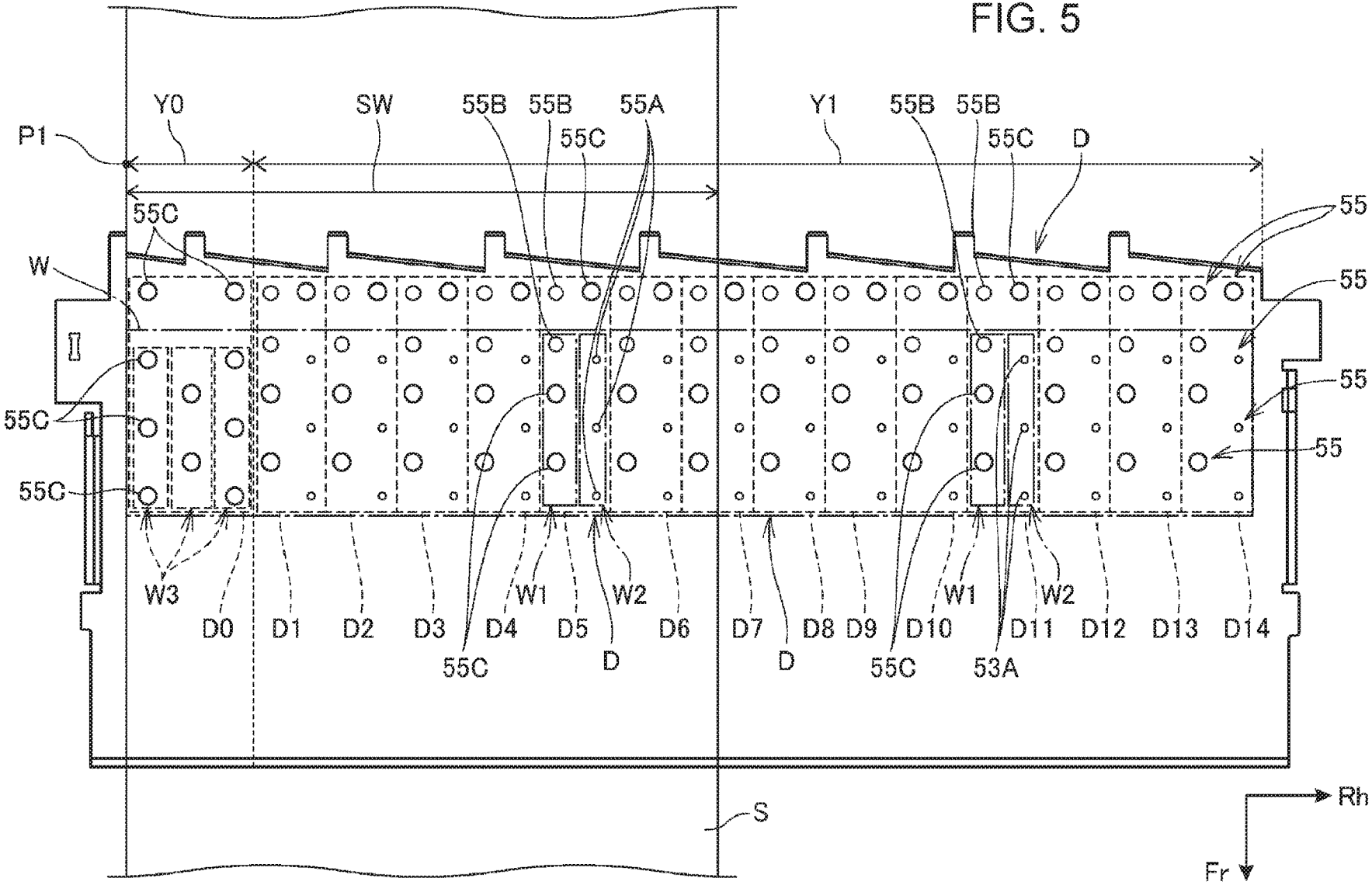
FIG. 5 is a plan view illustrating a suction platen.

FIG. 5 is a plan view illustrating the suction platen 51. The suction platen 51 has suction holes 55 that are through holes in the thickness direction. The suction holes 55 are formed at certain intervals in the transport direction and in the width direction to correspond to a print area W in which the ink jet head 25 faces when the ink jet head 25 is moved in the main scanning direction. While the suction fan 52 operates, a continuous sheet S is sucked through the suction holes 55 and the continuous sheet S is attracted by the suction platen 51, preventing the continuous sheet S from moving upward. On the downstream of the print area W, the star wheel unit 60 is disposed to face the suction platen 51 and the star wheels 61 prevent the continuous sheet S from moving upward.

The suction holes 55 according to the embodiment include small suction holes 55A, middle suction holes 55B each having a diameter larger than that of the small suction hole 55A, and large suction holes 55C each having a diameter larger than that of the middle suction hole 55B. The large suction hole 55C is an example first suction hole. The small suction hole 55A is an example second suction hole. The diameter of the large suction hole 55C is a diameter enough to achieve a suction amount that a continuous sheet S can be reliably sucked. The diameter of the large suction hole 55C is an example first diameter. On the other hand, the diameter of the small suction hole 55A is a diameter enough to achieve a suction amount that ink droplets discharged from the ink jet head 25 are not affected. The diameter of the small suction hole 55A is an example second diameter.

The suction platen 51 has a first suction portion W1 in which the large suction holes 55C and the middle suction hole 55B are arranged at predetermined intervals in the transport direction. In the first suction portion W1 according to the embodiment, an upstream end suction hole 55 in the transport direction is the middle suction hole 55B, and the suction holes 55 on the downstream of the middle suction hole 55B in the transport direction are the large suction holes 55C.

On the right side of the first suction portion W1, a second suction portion W2 that includes the small suction holes 55A arranged at predetermined intervals in the transport direction is provided. The suction holes 55 in the second suction portion W2 according to the embodiment are displaced to the downstream in the transport direction with respect to the suction holes 55 in the first suction portion W1. The right side is an example other side in the width direction. The first suction portion W1 and the second suction portion W2 may be referred to as a first suction array and a second suction array, respectively.

In this embodiment, the suction holes 55 are also provided outside the print area W. More specifically, on the upstream in the transport direction with respect to the first suction portion W1, an upstream middle suction hole 55B is provided with respect to the upstream end of the suction platen 51. On the upstream in the transport direction with respect to the second suction portion W2, an upstream large suction hole 55C is provided with respect to the upstream end of the suction platen 51.

A communication suction portion D includes the first suction portion W1, the second suction portion W2, which is on the right side of the first suction portion W1, the middle suction hole 55B, which is on the upstream of the first suction portion W1, and the large suction hole 55C, which is on the upstream of the second suction portion W2. A plurality of communication suction portions D are formed in the width direction. In this embodiment, fourteen communication suction portions D are provided. In FIG. 4, the communication suction portions D are denoted by D1, D2, D3, . . . , D14 in the order from the left.

On the left side with respect to the communication suction portion D1, the second communication suction portion D0 is provided. The second communication suction portion D0 includes third suction portions W3 in which the large suction holes 55C are arranged at predetermined intervals in the transport direction. The large suction holes 55C in the third suction portion W3 are displaced in the transport direction with respect to large suction holes 55C in the adjacent third suction portion W3 in the width direction.

In this embodiment, a continuous sheet S is guided along the left fixed guide 32 as a reference in the width direction. Accordingly, the left end of the continuous sheet S, which is a side end, is transported along a reference position P1 on the suction platen 51. Continuous sheets S that have larger sheet widths SW are transported more right side on the suction platen 51. More specifically, on the suction platen 51, there are an area through which a continuous sheet S having a minimum width passes, that is, an essential width area Y0 through which a continuous sheet S always passes irrespective of the sheet width SW, and a variable width area Y1 through which a continuous sheet S passes or do not pass depending on the sheet width SW of the continuous sheet S.

The second communication suction portion D0 is formed to correspond to the essential width area Y0. The communication suction portions D1 to D14 are formed to correspond to the variable width area Y1.

Figure 6:
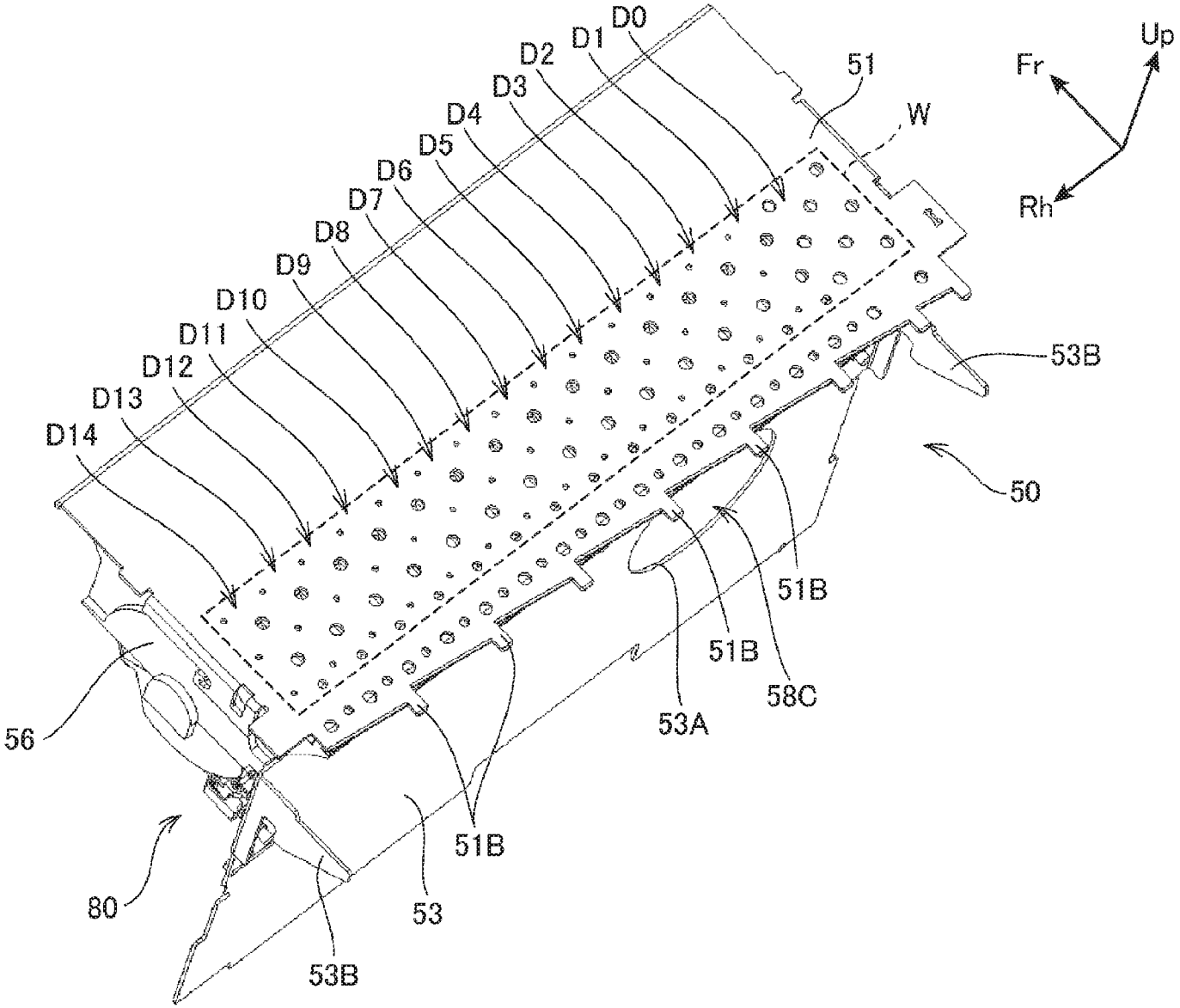
FIG. 6 is a perspective view of a platen unit viewed from an upper rear.
Figure 7:
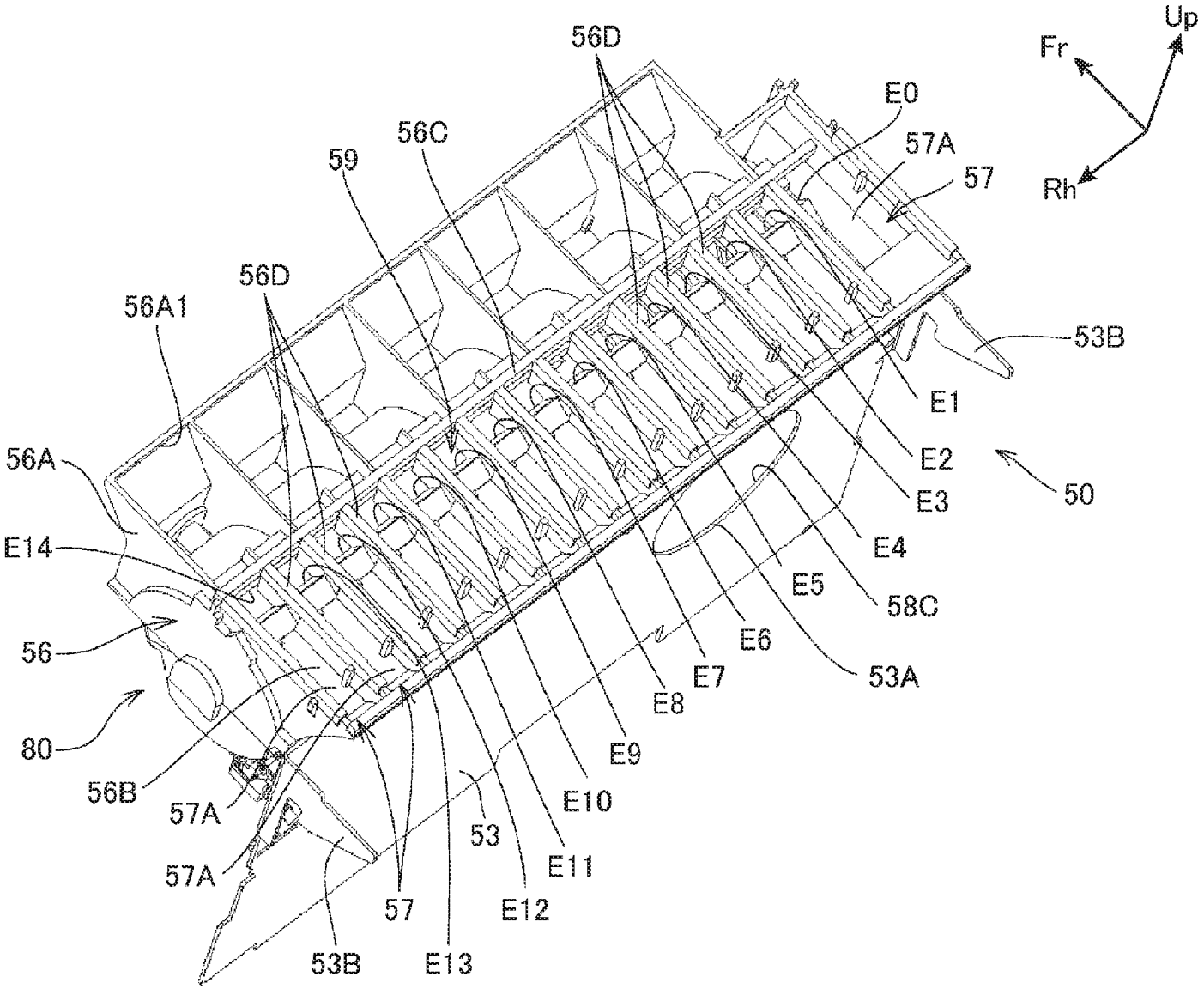
FIG. 7 is a perspective view in which a suction platen is omitted from the structure illustrated in FIG. 6.

FIG. 6 is a perspective view of the platen unit 50 viewed from the upper rear. FIG. 7 is a perspective view in which the suction platen 51 is omitted from the structure illustrated in FIG. 6. Below the suction platen 51, an upper duct member 56 is disposed. The upper duct member 56 is formed in a rectangular tube shape and has an opening long in the width direction. The upper duct member 56 has a rectangular tube-shaped outer wall 56A. In an upper part of the outer wall 56A, an opening 56A1 that opens upward is provided. In a lower part of the outer wall 56A, a bottom wall 56B that blocks a lower part of the outer wall 56A is provided.

The upper duct member 56 has a partition wall 56C that extends in the width direction. The partition wall 56C divides an interior space of the upper duct member 56 into a front space and a rear space. The partition wall 56C is formed to correspond to the downstream of the suction platen 51 in the print area W. On the upstream of the partition wall 56C, width partition walls 56D that extend in the transport direction are provided. The width partition walls 56D partition the space on the upstream of the partition wall 56C into spaces in the width direction. The width partition walls 56D are formed to correspond to the widths of the communication suction portions D0 to D14 of the suction platen 51 respectively. The shapes surrounded by the outer wall 56A, the partition wall 56C, and the width partition walls 56D define frame portions 57. An interior space of each frame portion 57 defines each suction chamber 57A. The bottom wall 56B has communication holes E0, E1, . . . , E14 that are through holes in the thickness direction and correspond to the suction chambers 57A. Accordingly, the communication holes E0 to E14 communicate respective corresponding suction chambers 57A. The communication holes E0 to E14 are arranged in line in the width direction of the upper duct member 56. Each frame portion 57 includes one first suction portion W1 and one second suction portion W2.

When the opening 56A1 of the upper duct member 56 is blocked by the suction platen 51, the suction chambers 57A face respective corresponding suction portions D0 to D14. More specifically, the suction chambers 57A communicate with the suction holes 55 in the respective corresponding suction portions D0 to D14.

As illustrated in FIG. 2 and FIG. 4, to a lower part of the upper duct member 56, a cover member 58 is coupled. The cover member 58 includes a front wall 58A that extends in the up-down direction and a bottom wall 58B that extends from a lower end of the front wall 58A toward the rear. The cover member 58 is supported by the fixed plate 53 and the side plates 54L and 54R, and defines a hollow space together with the fixed plate 53 and the side plates 54L and 54R. The hollow space defined by the cover member 58, the fixed plate 53, and the side plates 54L and 54R defines an air intake chamber 58C. The air intake chamber 58C communicates with the suction chambers 57A in the upper duct member 56 through the communication holes E0 to E14.

As illustrated in FIG. 6 and FIG. 7, in a left portion of the fixed plate 53, a circular opening 53A that is a through hole in the thickness direction is provided. The suction fan 52 illustrated in FIG. 2 is disposed behind the opening 53A. The suction fan 52 discharges the air in the air intake chamber 58C to the outside through the opening 53A to form a negative pressure in the air intake chamber 58C.

An air intake path 59 illustrated in FIG. 2 is defined by the opening 53A of the fixed plate 53, the air intake chamber 58C, the communication holes E0 to E14 of the upper duct member 56, and the suction chambers 57A of the upper duct member 56.

The suction fan 52 discharges the air in the interior space in the air intake path 59 that communicates with the suction chambers 57A to the outside. More specifically, the suction fan 52 functions as a suction unit that forms a negative pressure in the interior space in the air intake path 59 to produce a negative pressure in the suction holes 55.

Figure 8:
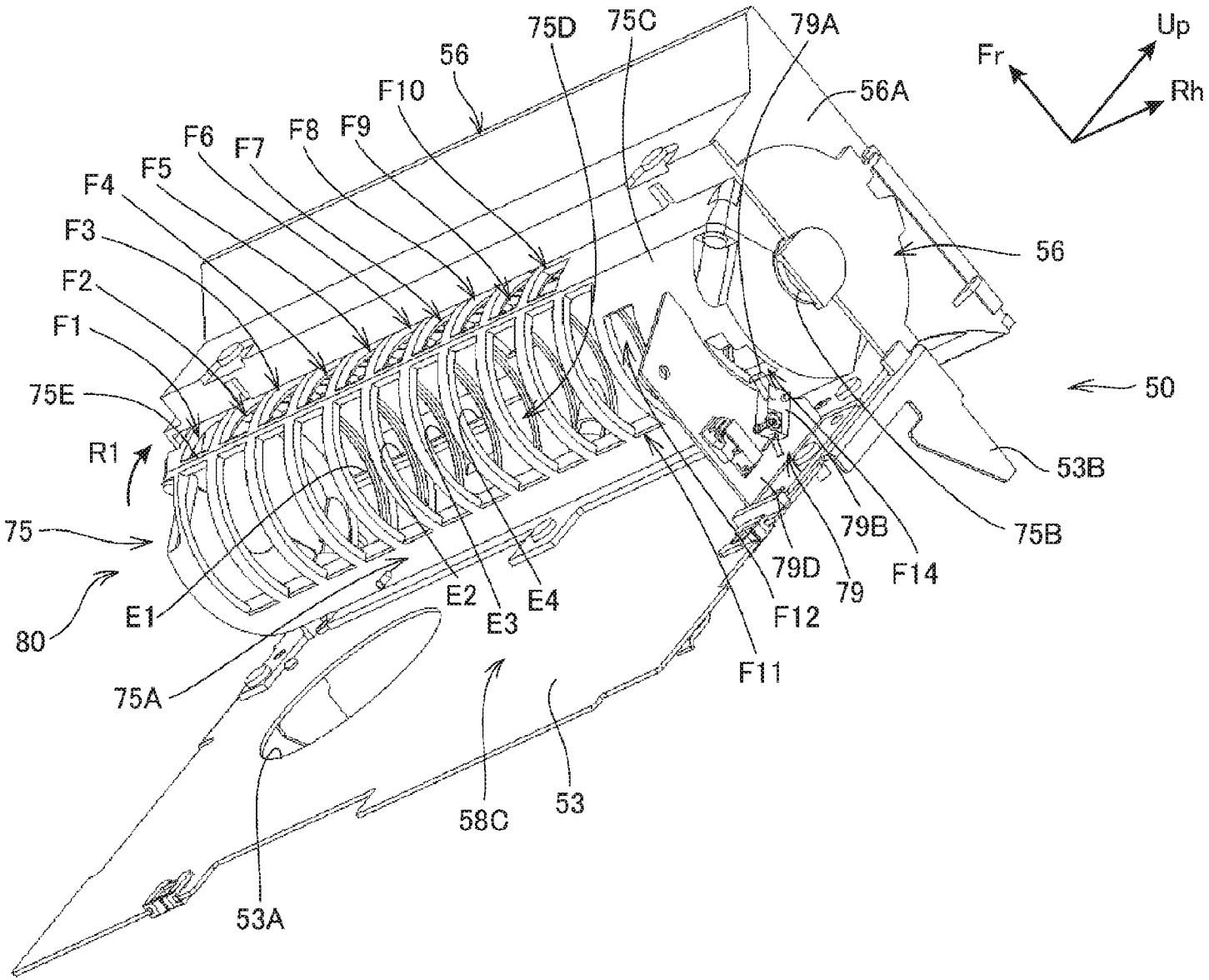
FIG. 8 is a perspective view of a platen unit in which the illustration of a cover member is omitted.

FIG. 8 is a perspective view of the platen unit 50 in which the illustration of the cover member 58 is omitted. A shutter drum 75 is disposed in the air intake chamber 58C. The shutter drum 75 is an example drum. The hollow rotary shutter drum 75 rotates about an axis that extends in the width direction. The shutter drum 75 includes a cylindrical section 75A and shaft sections 75B that are disposed at both ends of the cylindrical section 75A in the axis direction. The shutter drum 75 is rotatably supported by the side plates 54L and 54R with the shaft sections 75B.

The cylindrical section 75A of the shutter drum 75 is disposed to face the communication holes E1 to E14 of the upper duct member 56. The shutter drum 75, however, does not face the communication hole E0. More specifically, the communication hole E0 is not opened or closed by the shutter drum 75, and always communicates with the air intake chamber 58C.

The cylindrical section 75A of the shutter drum 75 has rectangular openings F1 to F14 that are through holes in the thickness direction. The rectangular openings F1 to F14 are example openings. Through the rectangular openings F1 to F14, a hollow space 75D in the shutter drum 75 and the air intake chamber 58C always communicate with each other.

The rectangular openings F1 to F14 are formed at predetermined intervals in the width direction. The rectangular openings F1 to F14 are formed to correspond to the communication holes E1 to E14 of the upper duct member 56. In this embodiment, the rectangular openings F1 to F14 each extend, from the same phase position in the circumferential direction, in a direction R1, which is a predetermined direction in the circumferential direction. The lengths of the rectangular openings F1 to F14 in the circumferential direction are gradually reduced from one end toward the other end in the width direction. The cylindrical section 75A has a block portion 75C that is a portion in which the rectangular openings F1 to F14 are not formed. In this embodiment, for the rectangular openings F1 to F14, depending on the lengths of the rectangular openings F1 to F14, a reinforcing portion 75E is provided across the rectangular openings F1 to F14.

When the rectangular openings F1 to F14 of the shutter drum 75 face the communication holes E1 to E14, the communication holes E1 to E14 that face the rectangular openings F1 to F14 are open, and the air intake chamber 58C communicates with the corresponding suction chambers 57A. When the block portion 75C faces the communication holes E1 to E14, the communication holes E1 to E14 that face the block portion 75C are closed, and the air intake chamber 58C does not communicate with the suction chambers 57A that face the block portion 75C.

Figure 9:
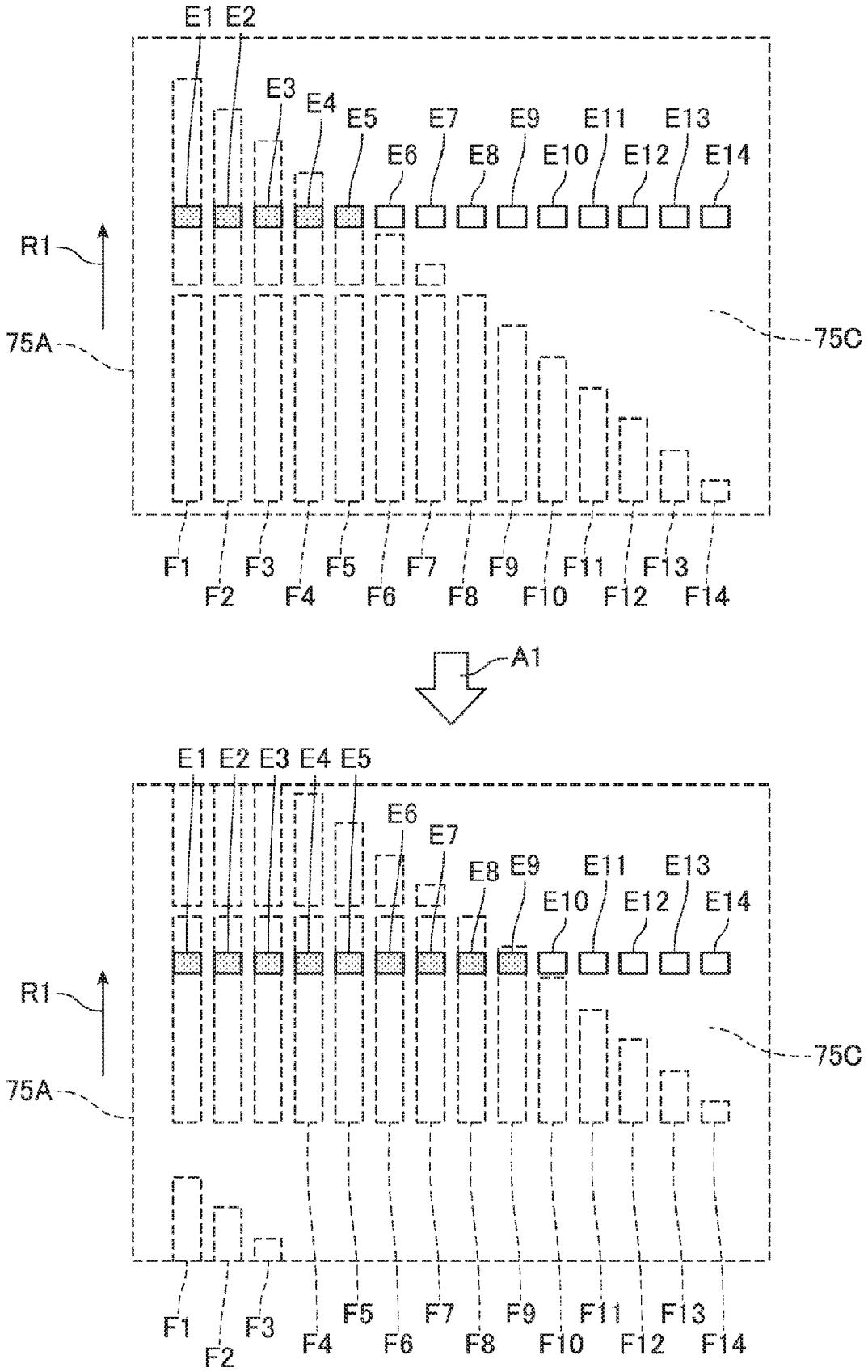
FIG. 9 is a schematic view illustrating a positional relationship between rectangular openings and communication holes.

FIG. 9 is a schematic view illustrating a positional relationship between the rectangular openings F1 to F14 and communication holes E1 to E14. FIG. 9 schematically illustrates the cylindrical section 75A of the shutter drum 75 that is developed into a plane, the view illustrating the movement of the rectangular openings F1 to F14 with respect to the communication holes E1 to E14 when the shutter drum 75 is rotated.

As illustrated in FIG. 9, when the shutter drum 75 is rotated in the direction R1 from a state in which the rectangular openings F1 to F5 face the communication holes E1 to E5 and the block portion 75C faces the communication holes E6 to E14, the positions of the rectangular openings F1 to F14 with respect to the communication holes E1 to E14 change. For example, as indicated by arrow A1, when the shutter drum 75 is further rotated by a predetermined rotation angle, the rectangular openings F1 to F9 face the communication holes E1 to E9 and the block portion 75C faces the communication holes E10 to E14. More specifically, by adjusting the rotation angle of the shutter drum 75, the number of the rectangular openings F1 to F14 to communicate with the communication holes E1 to E14 can be changed stepwise, and thus the number of the suction chambers 57A to communicate with the air intake chamber 58C can be changed stepwise.

By adjusting the rotation angle of the shutter drum 75 depending on the sheet width SW of a continuous sheet S, the suction holes 55 that correspond to the sheet width SW of the continuous sheet S can communicate with the air intake chamber 58C, and thereby the continuous sheet S can be sucked.

As illustrated in FIG. 4, the side plate 54L on the left side supports a drum drive unit 76 for driving the shutter drum 75. The drum drive unit 76 includes a drive motor 77 and a reduction gear mechanism 78 that transmits the power of the drive motor 77 to the shaft portions 75B of the shutter drum 75. The drive motor 77 is, for example, a DC motor with an encoder. The drive motor 77 rotates the shutter drum 75 in the predetermined direction R1. The drive motor 77 rotates the shutter drum 75 by a predetermined rotation angle.

As illustrated in FIG. 8, in the air intake chamber 58C, a home position sensor 79 for detecting a home position of the shutter drum 75 is disposed. The home position sensor 79 according to the embodiment is a switch type sensor. The home position sensor 79 includes a detector 79A that is swingably supported, an urging member (not illustrated) that urges the detector 79A in a predetermined direction, and a body 79B that outputs an electrical signal when the detector 79A is moved to a predetermined position. The home position sensor 79 detects whether the shutter drum 75 is rotated to a home position based on whether the detector 79A is rotated to the predetermined position.

The home position sensor 79 is supported with a stay 79D on a right portion of the fixed plate 53. The home position sensor 79 is disposed to face the cylindrical section 75A of the shutter drum 75. The home position sensor 79 according to the embodiment is disposed at a position in the width direction through which the rectangular opening F14 on the other end in the width direction passes. When the detector 79A that is in contact with the block portion 75C that is an outer surface of the shutter drum 75 is moved into the rectangular opening F14, the home position sensor 79 detects that the shutter drum 75 is rotated toward the home position. When the shutter drum 75 is further rotated, the detector 79A is pressed by the block portion 75C and retracted from the rectangular opening F14, and then the home position sensor 79 detects that the shutter drum 75 is moved from the home position.

A shutter mechanism 80 according to the embodiment includes the fixed plate 53, which defines the air intake path 59, the side plates 54R and 54L, the upper duct member 56, and the cover member 58. The shutter mechanism 80 also includes the shutter drum 75, the drum drive unit 76, and the home position sensor 79.

The platen unit 50 includes the shutter mechanism 80, and the suction platen 51 that is opened or closed by the shutter mechanism 80.

3. Operations of Printing Apparatus

In the printing apparatus 10, when a continuous sheet S is set and the printing start information is input, the printing apparatus 10 moves the carriage 26 in the main scanning direction. In this operation, the printing apparatus 10 detects a sheet width SW of the continuous sheet S by using a sensor (not illustrated) disposed in the carriage 26. Furthermore, the printing apparatus 10 rotates the shutter drum 75 in the direction R1 to detect the home position of the shutter drum 75. When the printing apparatus 10 detects the home position, the printing apparatus 10 rotates the shutter drum 75 from the home position by a rotation angle depending on the detected sheet width SW.

Figure 10:
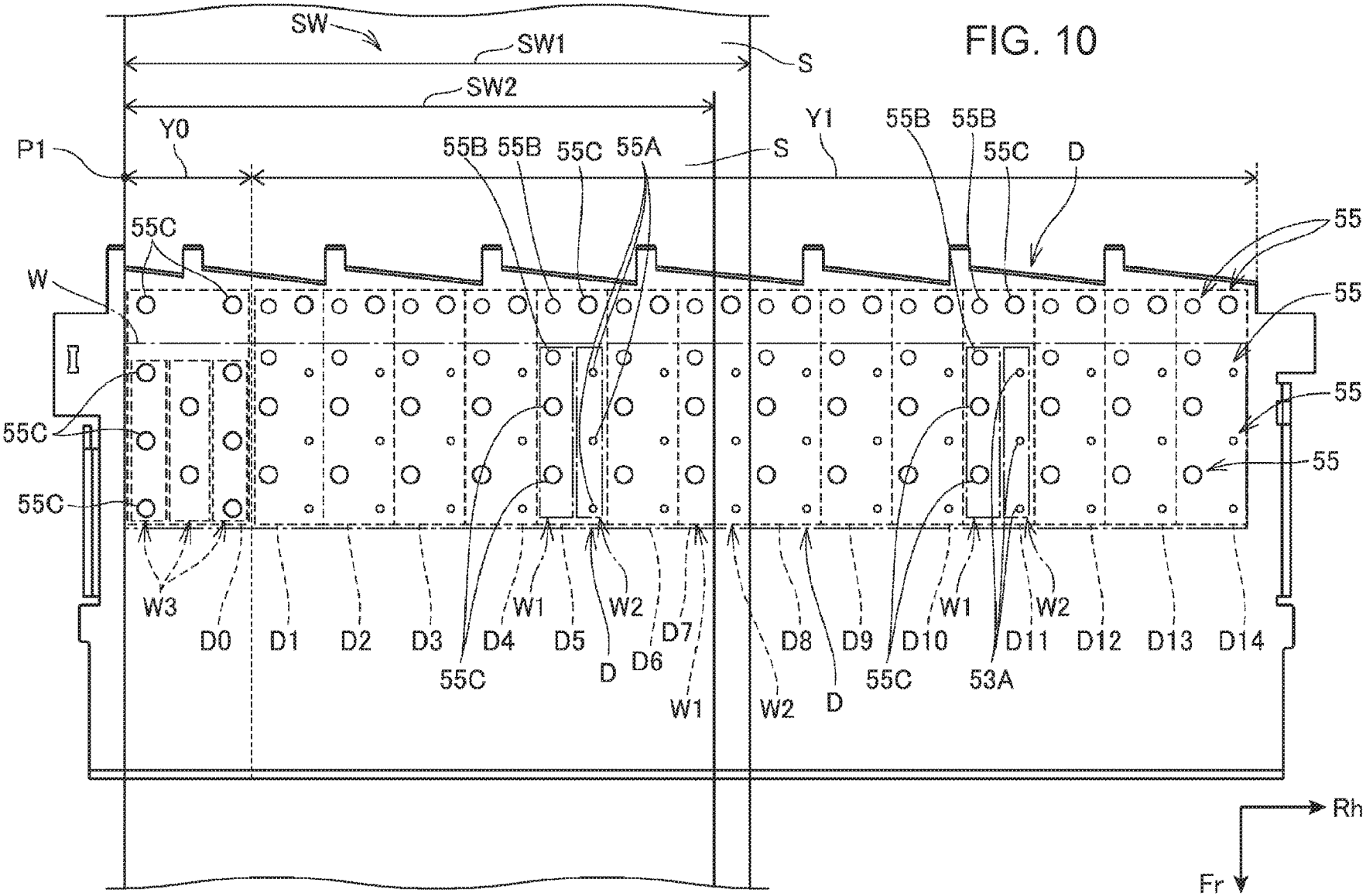
FIG. 10 illustrates a relationship between suction holes of a suction platen and a paper width.

FIG. 10 illustrates a relationship between the suction holes 55 of the suction platen 51 and a sheet width SW1 and a sheet width SW2. A case in which the sheet width is a sheet width SW1 that covers the communication suction portion D7 and does not cover the communication suction portion D8 will be described with reference to FIG. 10. When the sheet width is the sheet width SW1, the printing apparatus 10 rotates the shutter drum 75 such that the rectangular openings F1 to F7 communicate with the communication holes E1 to E7 and the block portion 75C blocks the communication holes E8 to E14. In this state, the printing apparatus 10 drives the suction fan 52 to form a negative pressure in the air intake path 59. By the operation, suction is performed through the suction holes 55 of the second communication suction portion D0 and the adjusted communication suction portions D1 to D7, and thereby the continuous sheet S of the sheet width SW1 is sucked.

Next, a case in which the sheet width is a sheet width SW2 that covers the first suction portion W1 of the communication suction portion D7 and does not cover the second suction portion W2 of the communication suction portion D7 will be described with reference to FIG. 10. When the sheet width is the sheet width SW2, the printing apparatus 10 rotates the shutter drum 75 such that the rectangular openings F1 to F7 communicate with the communication holes E1 to E7 and the block portion 75C blocks the communication holes E8 to E14. In other words, in the case of the sheet width SW2, the printing apparatus 10 rotates the shutter drum 75 similarly to the case of the sheet width SW1. In this state, the printing apparatus 10 drives the suction fan 52 to form a negative pressure in the air intake path 59. By the operation, suction is performed through the suction holes 55 of the second communication suction portion D0 and the adjusted communication suction portions D1 to D7, and thereby the continuous sheet S of the sheet width SW2 is sucked.

In general, in the suction platen mechanism in printing apparatuses, to suck a print medium of a sheet width, suction holes are provided throughout the suction platen in the width direction. However, when a print medium having a narrow sheet width is used, suction holes that are not covered by the print medium among the suction holes provided throughout in the width direction may produce a flow of air, and thereby the print quality may be decreased. To solve the problem, the suction holes that are not covered by the print medium are blocked by a shutter mechanism, however, many suction holes have to be blocked in known shutter mechanisms to correspond to a certain sheet width, and thus the known shutter mechanisms tend to have complex and large structures. Furthermore, the costs for the printing apparatuses tend to increase.

On the other hand, in this embodiment, the first suction portion W1 that has the array of the large suction holes 55C and the second suction portion W2 that has the array of the small suction holes 55A in the width direction are provided, and the communication suction portions D1 to D14 each having the pair of the first suction portion W1 and the second suction portion W2 are simultaneously opened or blocked. Accordingly, in the structure according to the embodiment, some second suction portions W2 in the communication suction portions D1 to D14 may not be blocked by a continuous sheet S. The second small suction holes 55A in the second suction portion W2 can suck a continuous sheet S, however, even though not all second small suction holes 55A are blocked by the continuous sheet S, the suction amount is so small that the ink droplets discharged from the ink jet head 25 are not affected. Consequently, it is not necessary to block the second suction portions W2 each having the array of the small suction holes 55A. With the structure according to the embodiment, the adjustment number of the suction holes 55 to be opened or closed depending on a sheet width SW can be reduced as compared to a case in which the suction holes 55 are to be opened or closed in each array in the width direction, that is, in each of the suction portions W1 and W2.

Accordingly, in this embodiment, the adjustment number can be reduced and the simplified structure for blocking the suction holes 55 can be provided as compared to the structures in which the adjustment number is large. In particular, in this embodiment, the number of the rectangular openings F1 to F14 is small and it is not necessary to provide a shutter drum 75 long in the circumferential direction to provide the rectangular openings F1 to F14 that have the lengths increased stepwise, and thus the diameter of the cylindrical section of the shutter drum 75 can be reduced. In this embodiment, the shutter mechanism 80 can be simplified and downsized.

Furthermore, in this embodiment, the home position sensor 79 is disposed in the air intake chamber 58C. With this structure, the compact structure can be achieved as compared to a structure in which the sensor is disposed outside the platen unit 50. In particular, the home position sensor 79 according to the embodiment detects the home position by using the rectangular opening F14 of the shutter drum 75. Accordingly, the rectangular opening F14 is used as the opening for opening or closing the communication hole E14 and also as the detection target for the home position sensor 79, that is, the rectangular opening F14 is used as the detection position of the home position sensor 79, and thus the compact structure can be provided.

As described above, the printing apparatus 10 according to the embodiment prints on a continuous sheet S. The printing apparatus 10 includes the suction platen 51 that is disposed in the transport path 21 of the continuous sheet S and has the suction holes 55, the suction fan 52 that sucks a continuous sheet S through the suction holes 55, the air intake path 59 that communicates with the suction holes 55, and the shutter mechanism 80 that opens or closes the air intake path 59. The suction platen 51 has the first suction portions W1 each having the large suction holes 55C arranged in the transport direction of the continuous sheet S. The suction platen 51 has the second suction portions W2 each having the small suction holes 55A arranged in the transport direction. The first suction portions W1 are provided alternately with the second suction portions W2 in a direction intersecting the transport direction, and each large suction hole 55C has the first diameter and each small suction hole 55A has the second diameter different from the first diameter. The air intake path 59 has the frame portions 57, and each frame portion 57 has the first suction portion W1 and the second suction portion W2, and the shutter mechanism 80 opens or closes stepwise the frame portions 57. With this structure, the first suction portions W1 and the second suction portions W2 can be simultaneously opened or closed, and the number of the suction holes 55 to be adjusted depending on a sheet width SW can be reduced, and thus the simplified and downsized structure of the shutter mechanism 80 can be provided.

In this embodiment, the diameter of the large suction hole 55C is larger than the diameter of the small suction hole 55A. Accordingly, by the suction from the large suction holes 55C, a continuous sheet S can be reliably sucked.

In this embodiment, the suction platen 51 has the reference position P1 along which an end of a continuous sheet S in the width direction passes through when the continuous sheet S is transported, and the frame portion 57 has the second suction portion W2 and the first suction portion W1 that is closer to the reference position P1 than the second suction portion W2. With this structure, the second suction portion W2 can be provided on the side end side of the continuous sheet S in the width direction, that is, on the right end side of the continuous sheet S, and the first suction portion W1 can be blocked even if the sheet width SW of the continuous sheet S is narrow. Consequently, with the structure that can simultaneously block the first suction portion W1 and the second suction portion W2, the continuous sheet S can be reliably sucked by the large suction holes 55C in the first suction portion W1.

In this embodiment, the shutter mechanism 80 includes the shutter drum 75 that has the rectangular openings F1 to F14 that correspond to the frame portions 57 and the drum drive unit 76 that drives the shutter drum 75 to rotate. In the direction that intersects the transport direction, the shutter drum 75 has a first group of the rectangular openings F1 to F14 and a second group of the rectangular openings F1 to F14 that have sizes different from the sizes of the rectangular openings F1 to F14 in the first group. With this structure, by adjusting the rotation angle of the shutter drum 75, the number of the rectangular openings F1 to F14 to face the communication holes E1 to E14 can be changed to adjust the communication holes E1 to E14 to be opened or closed.

In this embodiment, the shutter mechanism 80 includes the air intake chamber 58C that communicates with the frame portions 57 and the suction fan 52. The shutter drum 75 is disposed in the air intake chamber 58C and is rotated to open or close stepwise the frame portions 57. With this structure, by adjusting the rotation angle of the shutter drum 75, the suction chambers 57A communicate with the air intake chamber 58C stepwise.

The above-described embodiment is merely a specific example in implementing the present disclosure described in claims, and it is to be understood that the scope of the present disclosure is not limited to the embodiment, and various modifications can be made without departing from the scope of the present disclosure, for example, as described below.

In the above-described embodiment, the shutter drum 75 is rotated to open or close the communication holes E1 to E14, however, as described in JP-A-2012-101500, the communication holes E1 to E14 may be opened or closed by moving a valve element by using a cam mechanism.

What is claimed is:

1. A printing apparatus comprising:

a transport roller configured to transport a print medium in a transport direction;

a print head configured to print on the print medium;

a platen having first suction arrays each including at least a first suction hole having a first diameter and second suction arrays each including at least a second suction hole having a second diameter that is different from the first diameter, the first suction arrays and the second suction arrays being alternately arranged in a direction intersecting the transport direction;

a suction fan configured to suck the print medium through frame portions each having one first suction array and one second suction array; and a shutter mechanism configured to open or close the frame portions stepwise.

2. The printing apparatus according to claim 1, wherein the first diameter is larger than the second diameter.

3. The printing apparatus according to claim 2, wherein the platen has a reference position along which an end of the print medium in a width direction passes through, and each of the frame portions includes the second suction array and the first suction array that is closer to the reference position than the second suction array.

4. The printing apparatus according to claim 1, wherein the shutter mechanism comprises a drum having first openings corresponding to the frame portions and second openings of sizes different from the sizes of the first openings, the first openings and the second openings being arranged in the direction intersecting the transport direction, and a drum drive unit configured to drive the drum to rotate.

5. The printing apparatus according to claim 4, wherein the shutter mechanism comprises an air intake chamber that communicates with the frame portions and the suction fan, and the drum is rotated in the air intake chamber to open or close stepwise the frame portions.

* * * * *